US008745804B2

(12) United States Patent
Jaksha

(10) Patent No.: US 8,745,804 B2
(45) Date of Patent: Jun. 10, 2014

(54) STAINLESS STEEL TOOTHBRUSH WITH THERMOCHROMIC DISPLAY

(76) Inventor: Steven Jaksha, San Diego, CA (US)

( * ) Notice: Subject to any disclaimer, the term of this patent is extended or adjusted under 35 U.S.C. 154(b) by 132 days.

(21) Appl. No.: 12/830,247

(22) Filed: Jul. 2, 2010

(65) Prior Publication Data

US 2011/0047735 A1 Mar. 3, 2011

Related U.S. Application Data

(60) Provisional application No. 61/237,521, filed on Aug. 27, 2009.

(51) Int. Cl.
*A46B 5/00* (2006.01)

(52) U.S. Cl.
USPC ..... 15/167.1; 15/143.1; 433/117; 433/118; 433/119

(58) Field of Classification Search
USPC ..... 15/22.1, 143.1, 167.1; 40/314; 433/80, 433/90, 114, 117, 118, 119, 125
IPC ..... A46B 9/04
See application file for complete search history.

(56) References Cited

U.S. PATENT DOCUMENTS 2,631,320 A * 3/1953 Bressler ..... 15/167.1
4,399,582 A * 8/1983 Ernest et al. ..... 15/176.4
4,665,921 A * 5/1987 Teranishi et al. ..... 607/75
4,694,844 A * 9/1987 Berl et al. ..... 15/167.1
5,400,457 A 3/1995 Ridgley
5,408,717 A * 4/1995 Wenzer ..... 15/167.1
5,913,346 A * 6/1999 Narwani ..... 15/111
6,009,589 A * 1/2000 Driesen et al. ..... 15/167.1
6,039,938 A 3/2000 Kutchko
6,269,515 B1 * 8/2001 Varma ..... 15/160
6,327,734 B1 * 12/2001 Meginniss et al. ..... 15/105
6,334,232 B1 * 1/2002 Sato ..... 15/167.2
6,675,425 B1 * 1/2004 Iimura ..... 15/105
7,430,778 B2 * 10/2008 Gatzemeyer et al. ..... 15/22.2
7,448,108 B2 * 11/2008 Gatzemeyer et al. ..... 15/22.1
7,478,452 B2 * 1/2009 Rosenblood et al. ..... 15/111
7,544,204 B2 * 6/2009 Krespi et al. ..... 607/88
7,562,411 B2 * 7/2009 Gavney, Jr. ..... 15/22.2
7,607,190 B2 * 10/2009 Moskovich et al. ..... 15/167.1
7,703,163 B2 * 4/2010 Jimenez et al. ..... 15/22.1
7,725,972 B2 * 6/2010 Berde et al. ..... 15/22.1
7,921,499 B2 * 4/2011 Huber et al. ..... 15/167.1
7,937,794 B2 * 5/2011 Huber et al. ..... 15/167.1
7,975,343 B2 * 7/2011 Hohlbein et al. ..... 15/110
8,011,054 B2 * 9/2011 Nanda ..... 15/105
8,156,599 B2 * 4/2012 Waguespack et al. ..... 15/104.94

(Continued)

FOREIGN PATENT DOCUMENTS

JP 2003250636 A * 9/2003

*Primary Examiner* — Monica Carter
*Assistant Examiner* — Michael Jennings
(74) *Attorney, Agent, or Firm* — George S. Levy

(57) ABSTRACT

A toothbrush comprising at one of its ends, a handle, and at its other end, a head carrying bristles on one of its sides. A stainless steel cladding covers the head and the handle. As a variation, the head and handle can be made of stainless steel with a plastic plate attached to the head and carrying bristles. As an option, a tongue scraper can be incorporated at the tail end of the handle. As yet another variation the handle can carry a thermochromic material to provide a measure of temperature or to display an image or a text message.

11 Claims, 6 Drawing Sheets

(56) References Cited

U.S. PATENT DOCUMENTS

| | | | | |
|---|---|---|---|---|
| 2002/0107537 | A1 | 8/2002 | Singh | |
| 2003/0089673 | A1 | 5/2003 | Herren | |
| 2005/0193510 | A1* | 9/2005 | Kemp | 15/143.1 |
| 2006/0070195 | A1* | 4/2006 | Morita et al. | 15/105 |
| 2009/0000797 | A1 | 1/2009 | Wood | |
| 2009/0025165 | A1* | 1/2009 | Moskovich et al. | 15/167.1 |
| 2009/0271936 | A1* | 11/2009 | Walanski et al. | 15/105 |
| 2011/0091391 | A1* | 4/2011 | Ribi | 424/48 |

* cited by examiner

STAINLESS STEEL TOOTHBRUSH WITH THERMOCHROMIC DISPLAY

This invention claims the benefit of U.S. Provisional Application No. 61/237,521 with the title, "Stainless Steel Toothbrush" filed on Aug. 27, 2009 and which is hereby incorporated by reference. Applicant claims priority pursuant to 35 U.S.C. Par 119(e)(i). The present invention relates to toothbrushes. More particularly it relates to toothbrushes configured to minimize oral odors. It also relates to toothbrushes equipped with temperature sensitive material, or fitted with temperature measuring and displaying components.

U.S. Pat. No. 4,154,106 by Inoue, et al, and U.S. Pat. No. 6,039,938 by Kutchko are hereby incorporated by reference.

FIELD OF THE INVENTION

Background

Halitosis, most commonly called bad breath, affects a large percentage of the population, estimated by the American Dental Association to be over 90%. The prior art describes many methods for treating this problem, which make use of special composition formulated as toothpaste or mouthwash.

For example U.S. Pat. No. 7,347,985 by Maxwell et al teaches a composition comprising magnolia bark extract.

U.S. Pat. No. 7,135,195 by Holladay et al, recommends a composition that includes particles made of silver and silver oxide, suspended in water.

Yet another U.S. Pat. No. 6,746,697 by Wolfson describes a composition based on Heliopsis longpipes roots.

Yet another U.S. Pat. No. 6,419,903 by Xu et al describes a homogeneous mixture of a water soluble, low viscosity hydroxyalkylmethyl cellulose and a water dispersible starch and a flavoring agent.

All the above prior patents describe methods with potential side effects as they rely on chemicals that must be introduced in the body.

Herren in US Patent Application 20030089673 teaches a stainless steel toothbrush holder.

There is a need for a safe chemical-free deodorizing system configured as a toothbrush to remove mouth odors.

None of the prior art offers the utility value of this invention. Further features, aspects, and advantages of the present invention over the prior art will be more fully understood when considered with respect to the following detailed description claims and accompanying drawings.

SUMMARY OF THE INVENTION

The present invention is a toothbrush for treating halitosis. This toothbrush comprises a handle, a head and bristles. The head is partially covered with a cladding made of a smooth metal alloy such as stainless steel, which can absorb odors. The cladding covers the back of the head of the toothbrush, which is the part not covered by bristles. As a variation, the cladding can be extended to also cover the handle. As another variation, the toothbrush comprises a handle and a head forming a single stainless steel piece, and also comprises a plastic plate which is affixed to one side of the head and which carries bristles.

A variation of this invention is a toothbrush that is comprised of a tongue scraper.

Yet another variation is a toothbrush that includes a thermochromic material in the handle, thereby allowing the toothbrush to display a temperature, an image or a message, for example, when it is held or when it is placed in hot water.

DETAILED DESCRIPTION

Foods like onion and garlic, members of the allium genus of plants, contain chemicals that form sulfurous compounds when they react with the air (nitrogen, oxygen or hydrogen). Onion forms sulfur oxides and sulfuric acid when cut. Onions and garlic contain amino acid sulfoxides, which form sulfenic acids, which then produces a volatile gas (propanethiol S-oxide), which, in turn, generates sulfuric acid upon exposure to water. These compounds have characteristic scents and are throat and eye irritants. Garlic also forms allyl methyl sulfide, a compound that does not break down in the body but is expelled through pores and the breath. Oxidation of these compounds can reduce their effects. Metals that compose the alloy stainless steel have catalytic properties and can enhance the oxidation of these odorous compounds.

Figure 1:
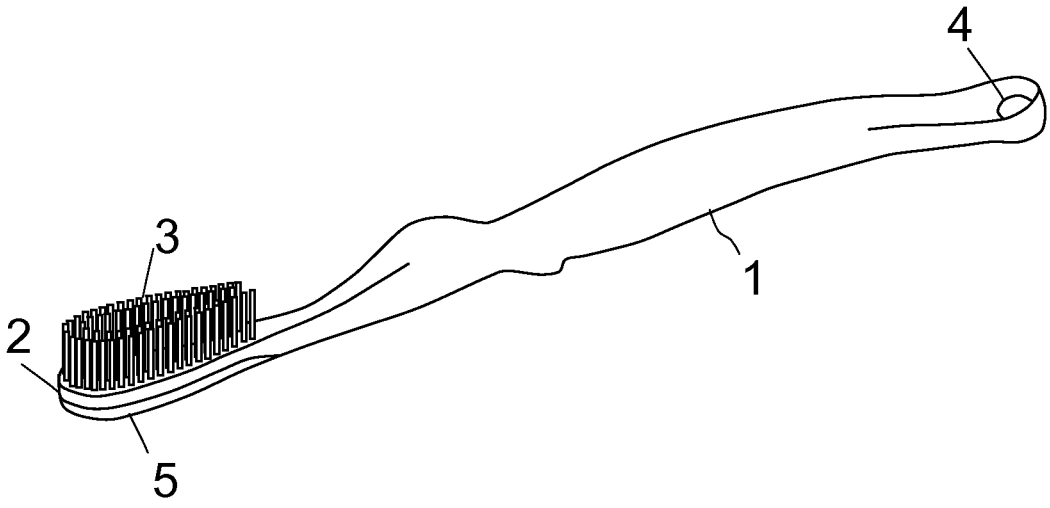
FIG. 1 is a perspective view of the toothbrush showing the bristles and the tongue scraper.
Figure 2:
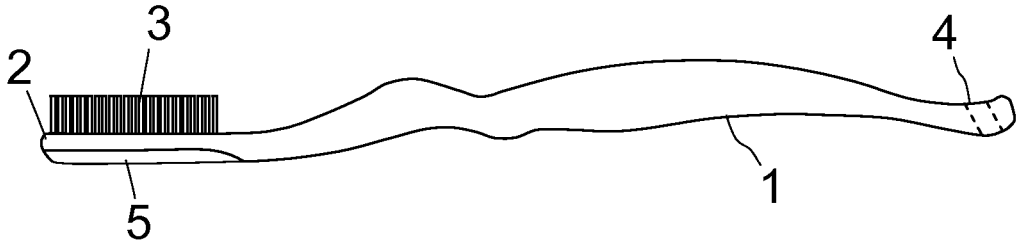
FIG. 2 is a side view of the toothbrush.
Figure 2A:
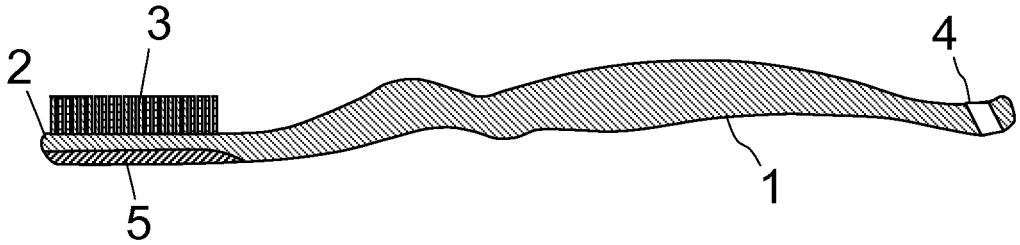
FIG. 2A is a side view of the toothbrush in cross-section.
Figure 3:
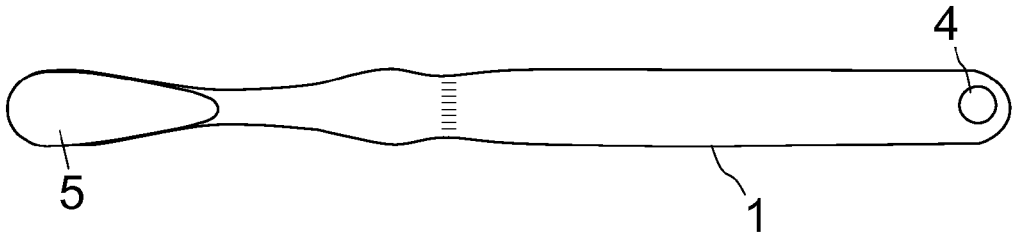
FIG. 3 shows the back side of the toothbrush including the stainless steel cladding.

This invention is illustrated in FIG. 1. It consists of a toothbrush equipped with a stainless steel cladding 5 partially covering the end 2 that carries the bristles 3. This stainless steel-clad toothbrush is designed to assist in the removal of odors and clean the teeth and intra-oral mucosa tissue by brushing and rubbing oral tissues in the presence of water and dentifrice. Odor molecules bond to the stainless steel surface and are washed away by liquid.

As illustrated in FIGS. 1, 2, 2A, and 3 the toothbrush comprises a handle 1, a head 2 covered on one of its sides with bristles 3, and a stainless steel cladding 5 covering the side of the head 2 without bristles. Except for the cladding 5, the rest of the toothbrush including the handle 1, the head 2 and the bristles 3 are made, as a typical toothbrush, of a convenient material such as plastic.

Figure 4:
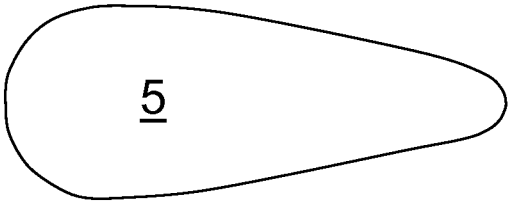
FIG. 4 shows the stainless steel cladding in top view.
Figure 4A:
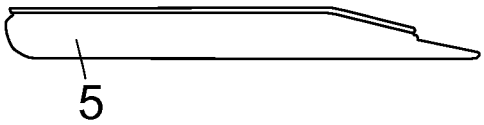
FIG. 4A illustrates the stainless steel cladding in side view.
Figure 4B:
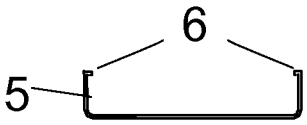
FIG. 4B shows a cross section of the stainless steel cladding.

The stainless steel cladding 5 is shown in top view in FIG. 4 and in side view in FIG. 4A. It is also shown in cross-section in FIG. 4B. The cross section is essentially shaped as a U which is configured at its tips to include inward pointing cramps or undercuts 6 that are to be embedded during manufacturing into the edges of the head of the toothbrush for better retention of the cladding.

Figure 4C:
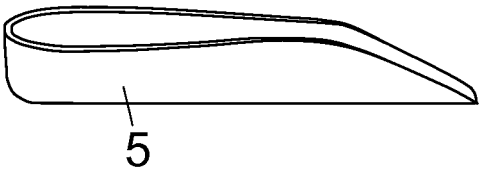
FIG. 4C shows in perspective a variation of the stainless steel cladding covering more of the head.
Figure 4D:
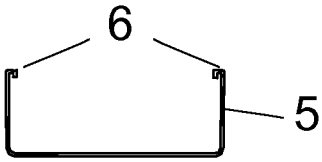
FIG. 4D provides a cross-sectional view of the variation shown in FIG. 4C.

A possible variation to the cladding design is shown in perspective in FIG. 4C and in cross-section in FIG. 4D. The cramps or undercuts 6 are turned inward and down and are designed to wrap around most of the head 2 except for the side that carries the bristles 3. The cramp or undercut allows for a smooth plastic to stainless steel transition to avoid trauma to intra-oral tissue.

In yet another variation, the cladding 5 can extend to cover the whole handle 2 to provide a more hygienic product.

Figure 5:
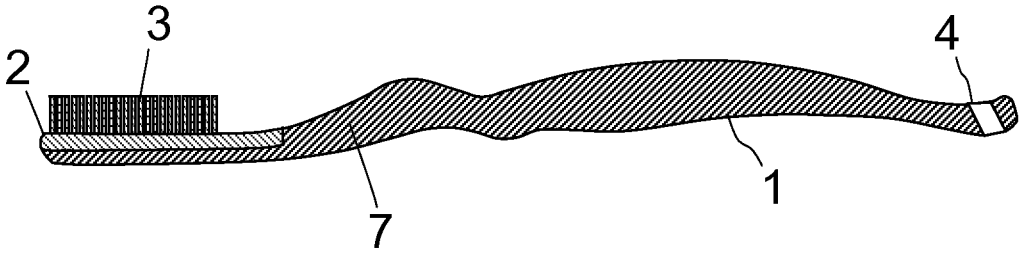
FIG. 5 shows in a cross-section view how the head made of plastic can be embedded into a stainless steel handle.

In a further variation shown in FIG. 5, the toothbrush may be constructed mostly of stainless steel 7, except for the part of the head 2 that carries the bristles 5, which may be made of plastic.

In yet a further variation, as shown in FIGS. 1, 2, 2A, 3 and 5, this invention may include a tongue scraper 4 configured at the end of the handle 2.

Manufacturing of the plastic components of the toothbrush follows a conventional toothbrush manufacturing process. For example, the plastic can be extrusion-molded with the stainless steel cladding applied during the molding process. The bristles can be embedded in the plastic using small metal staples to hold folded bundles of bristles into holes configured into the toothbrush head. As shown in FIG. 5, the stainless steel cladding covers the head and the handle, and is configured with an opening through which the bristles pass. It is clear from the drawings that the invention is a toothbrush devoid of any articulation, or hinges, wherein all components are solidly attached to each other.

It is clear to a person having skill in the arts and in view of the U.S. Pat. No. 6,039,938 by Kutchko who teaches the use of "smooth external surface made of metal alloy," that stainless steel is not the only metal that could be employed in the construction of a hygienic toothbrush to eliminate or reduce halitosis.

Figure 6:
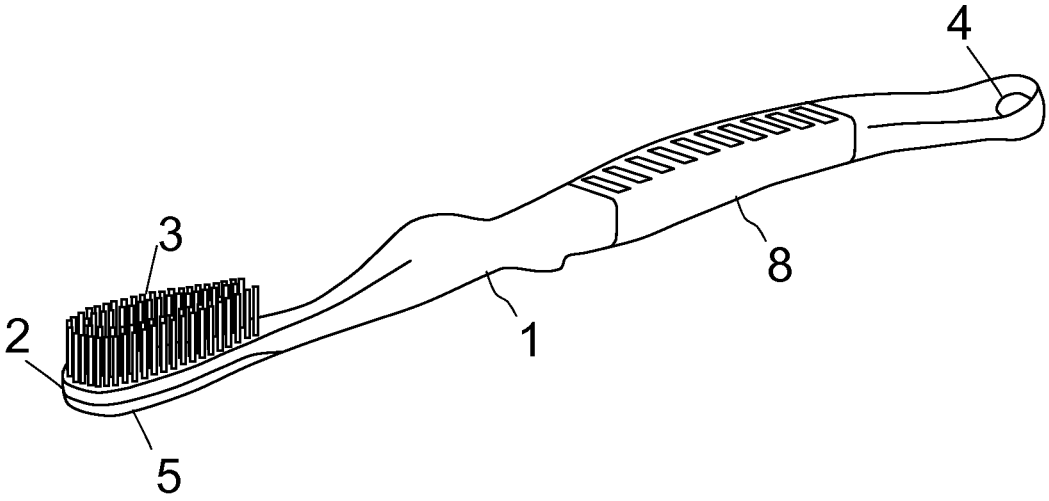
FIG. 6 illustrates how a thermochromic material can be incorporated in the handle of the toothbrush.

Yet another variation shown in FIG. 6 is a toothbrush that includes a thermochromic material 8 embedded in the handle, thereby allowing the toothbrush to display a temperature, an image or a message, for example, when it is held or when it is placed in hot (or cold) water. This material, by changing color with temperature, may indicate to the user whether the toothbrush has recently been held. By placing the handle under the water tap, it can also indicate the temperature of the water. By including different grades, each grade having a color transition at a different temperature, it is possible to display a temperature reading or an image on the handle. It is also possible to display a message such as "Floss Every Day" or "Jack Shaw, DDS, (789)-123-4567."

The material is sometimes referred to as Thermochromic Liquid Crystal material or as Temperature Sensitive Liquid Crystal material. This material can be highly temperature sensitive and change to many colors. It can be formulated to change temperature from −25 to +250° F. (−30 to 120° C.), and can be sensitive enough to detect changes as small as 0.2° F. The color will start black in the colder temperature ranges and go through the colors of a rainbow with increased heat application. The material is reversible in that it can be used over and over again, almost indefinitely. Popular liquid crystal applications include aquarium thermometers, medical forehead thermometers, watches, laptop computers and "stress" cards.

Thermochromic liquid crystal material can be purchased and utilized in many ways. The thermochromic liquid crystal material can be incorporated within the body of the brush handle (mid-section, grip area) as a strip of a Mylar sheet material (0.008" thick). Larger dimensions of thermochromic liquid crystal plastic can also be incorporated into the plastic handle at the manufacturing stage.

Thermochromic crystals 3 to 5 micron in size and dispersed within this polymer matrix exhibit total color spectrum shift with temperature change. This addition to the toothbrush will give the person using the toothbrush a visual affirmation and motivation as to how long they should be using the toothbrush because the longer the toothbrush handle is held and used will give greater positive, more vibrant color changes.

While the above description contains much specificity, the reader should not construe this as limitations on the scope of the invention, but merely as examples of preferred embodiments thereof. Those skilled in the art will envision many other possible variations within its scope. Accordingly, the reader is requested to determine the scope of the invention by the appended claims and their legal equivalents, and not by the examples which have been given.

I claim:

1. A toothbrush comprising a handle at one of its ends, a head at its other end, said handle and said head being non-detachably affixed to each other, one side of said head carrying bristles, and also comprising a stainless steel cladding covering said head, said cladding covering all said sides of said head not covered by bristles, wherein the stainless steel cladding having a cross-sectional U-shaped configuration including undercuts that are turned down and inward, the undercuts wrapping around the head not covered by bristles.

2. The toothbrush of claim 1 also comprised of a tongue scraper.

3. The toothbrush of claim 1 wherein said handle carries a thermochromic material.

4. The toothbrush of claim 3 wherein said thermochromic material provides a display of temperature.

5. The toothbrush of claim 3 wherein said thermochromic material provides a display of an image.

6. The toothbrush of claim 3 wherein said thermochromic material provides a display of a text message.

7. A toothbrush consisting of a number of components, all of said components being solidly attached to each other, said components comprising a handle at one of said end of toothbrush, a head at said other end of said toothbrush, said handle and including stainless steel portions at each end and a thermochromic material between each end of said stainless steel portions, said head including a top and a bottom portion, said bottom portion including a stainless steel portion and said to portion including a plastic plate portion, said bottom side of said head being non-detachably affixed to said plastic plate of said top portion of said head, and bristles being embedded in said plastic plate.

8. The toothbrush of claim 7 wherein said components also comprise a tongue scraper.

9. The toothbrush of claim 7 wherein said thermochromic material provides a display of temperature.

10. The toothbrush of claim 7 wherein said thermochromic material provides a display of an image.

11. The toothbrush of claim 7 wherein said thermochromic material provides a display of a text message.

* * * * *